United States Patent [19]
Pfeiffer
[11] 4,226,638
[45] Oct. 7, 1980

[54] METHOD OF MANUFACTURING XYLOSE SOLUTION FROM XYLAN-CONTAINING RAW MATERIAL

[75] Inventor: Hansjorg Pfeiffer, Winterthur, Switzerland

[73] Assignee: Sulzer Brothers Ltd., Winterthur, Switzerland

[21] Appl. No.: 9,494

[22] Filed: Feb. 5, 1979

Related U.S. Application Data

[63] Continuation-in-part of Ser. No. 811,192, Jun. 29, 1977, abandoned.

[30] Foreign Application Priority Data

Jul. 1, 1976 [CH] Switzerland ..... 8428/76

[51] Int. Cl.[3] ..... C13K 1/02; C13D 1/00

[52] U.S. Cl. ..... 127/37; 127/1; 127/45

[58] Field of Search ..... 127/1, 37, 45

[56] References Cited

U.S. PATENT DOCUMENTS

| | | | |
|---|---|---|---|
| 787,102 | 4/1905 | Lorenz | 127/45 |
| 2,086,963 | 7/1937 | Scholler | 127/1 |
| 2,474,669 | 6/1949 | Hereng | 127/37 |
| 3,275,472 | 9/1966 | Tantawi et al. | 127/45 X |
| 3,523,911 | 8/1970 | Funk et al. | 127/37 X |
| 4,023,982 | 5/1977 | Knauth | 127/37 X |

OTHER PUBLICATIONS

Pigman, W. and Horton, D., *The Carbohydrates,* vol. IIA, N.Y., Academic Press, 1970, Chapter 37, pp. 452–453, by R. L. Whistler and E. L. Richards, *Hemicelluloses.*

*Primary Examiner*—Frank W. Lutter
*Assistant Examiner*—Roger F. Phillips
*Attorney, Agent, or Firm*—Kenyon & Kenyon

[57] ABSTRACT

Xylan-containing raw material which is very absorbent in the dry state, particularly one year old plants, is treated with an acid either by spraying or by an acid vapor to a limited extent. The extent of treatment is sufficient to permit hydrolysis of the xylan to xylose without complete saturation of the raw material. After hydrolysis, the raw material is washed in counterflow with water to extract the xylose solution. Washing may be accomplished in an extraction column or in a multistep mixing arrangement.

9 Claims, No Drawings

METHOD OF MANUFACTURING XYLOSE SOLUTION FROM XYLAN-CONTAINING RAW MATERIAL

This is a continuation-in-part of U.S. patent application Ser. No. 811,192 filed June 29, 1977, and now abandoned.

The invention relates to a method of manufacturing a xylose solution. More particularly, this invention relates to a method of making a xylose solution from xylan-containing raw material, which is very absorbent in the dry state, in particular annual plants, wherein the xylan is hydrolysed by a treatment with acid and the xylose solution formed is extracted.

As is known, one-year plants (i.e. annuals) and wood, as well at the solid residues resulting when using such plants, contain xylan. However, generally, the residues, for example bagasse, bagasse pith, grain straw, husks of cereals and saw dust, are of small particle size and/or very absorbent in the dry state as a result of their strong porosity and large specific surface area.

Heretofore, the technique of hydrolysis for obtaining a xylose solution comprised immersing the material to be hydrolysed in an acid solution until saturation has occurred; e.g. as described in U.S. Pat. No. 4,023,982. Subsequently, the raw material is maintained at a certain elevated temperature for a certain time, during which the xylan is hydrolysed and whereupon the xylan solution is extracted by means of water in a counter-current column. Another method is disclosed in U.S. Pat. No. 3,523,911 wherein the raw material is treated at temperatures of 100° to 150° C. by adding acid-vapor mixtures condensing on the raw material and dripping off extracting sugar from the raw material thereby.

As a result of the high water content, the quantity of acid needed with these methods is very large and a hydrolysate with very low xylose is obtained. As an example, if 15% xylan, on the basis of dry material, is hydrolysed from bagasse, then the xylose content in the hydrolysate amounts to only 3% due to the large quantity of water absorbed, viz. about 500 to 600% on the basis of dry material. When extracting the hydrolysate a further dilution takes place. The resulting high costs for acid and the evaporation of the xylose solution render the method uneconomical.

Accordingly, it is an object of the invention to provide a method of making a xylose solution which requires a small amount of acid solution.

It is another object of the invention to reduce the costs of evaporating a xylose solution in order to concentrate the xylose solution.

Briefly, the invention provides a method of manufacturing a xylose solution from a xylan-containing raw material which comprises the steps of treating the raw material with an acid to an extent sufficient to permit hydrolysis of the xylan to xylose without completely saturating the raw material. In addition, the method comprises the steps of heating the raw material to a temperature sufficient to effect hydrolysis of the xylan to a xylose solution and of thereafter washing the acid treated and heated raw material in counterflow water to extract the xylose solution.

The method is particularly adapted to raw material which includes annual plants and particularly to raw material which is very absorbent in a dry state.

In order to treat the raw material with an acid, the acid may be sprayed in the form of an acid solution or use may be made of an acid vapor which passes through the raw material. In the former case, the raw material is heated to the hydrolysis temperature by passing a flow of water vapor through the raw material. In the latter case, passing of an acid vapor through the raw material simultaneously effects heating of the raw material to the hydrolysis temperature.

In one embodiment, the acid is sprayed into the raw material in the form of an acid solution to the extent that the raw material contains an amount of acid solution sufficient for the following hydrolysis, however, without being sucked full. Thereafter the material is heated to the reaction temperature by means of water vapor and finally subjected to an extraction operation in counter-current flow.

The impregnation and heating of the raw material may alternatively be carried out with acid vapor.

In extracting the xylose solution, the hydrolysed raw material may traverse an extraction column; the formed xylose being extracted from the raw material by water which flows in countercurrent to the raw material.

In case the structure of the hydrolysed raw material prohibits extraction in a column, the extraction may take place by a multiple-step mixing of the hydrolysed raw material with washing water and subsequent separation of both, the washing being directed in counter flow to the raw material. This may be done such that the hydrolysed raw material is applied to a travelling screen which travels through several series connected washing-water spraying zones; the washing water of one spraying zone, after having traversed the raw material, constituting the washing water for the preceeding spraying zone.

In case the hydrolysed raw material is not able to pass washing water sufficiently, not even when in thin layers, then the extraction may take place by means of squeezing which is repeated several times for example by means of a sequence of presses in such manner, that at least one washing-water admixing zone is followed by a squeezing zone for the hydrolyzed raw material, and that the first washing-water admixing zone precedes a squeezing zone.

According to a preferred embodiment of the method, the extraction is carried out in such a way that before being supplied to the extraction device, the hydrolysed raw material is suspended in a hydrolyzate derived from one of the squeezing or washing states. The hydrolyzate used for the preparation of the suspension is preferably taken from the washing or squeezing stage in which the hydrolysate contains the highest concentration of xylose ultimately obtainable.

These and other objects and advantages of the invention will become more apparent from the following detailed description of various examples of the invention.

According to need, the raw material is brought into a state suitable for processing by means of mechanical cleansing and subsequent reduction to small pieces. Raw material which contains a large amount of water as, for example bagasse pith produced by a wet depithing process, is dehydrated to a water content of about 50%.

The following treatment of the raw material with acid may take place by spraying the raw material with an aqueous solution of mineral acids and/or organic acids, for example in a paddle conveyor, which provides for a good mixing and stirring of the raw material. The quantities of liquid and their acid concentration are selected such that after spraying, the raw material contains a sufficient quantity of acid without being completely saturated (sucked full), as would be the case when impregnating by immersion. Subsequently, the raw material is heated to the hydrolysis reaction temperature by passing a flow of water vapor through the raw material, the raw material being vented simultaneously thereby. The raw material is maintained at this reaction temperature for the required duration of time and hydrolysed thereby, so that xylose is formed. After the reaction is completed, the xylose is dissolved in the liquid (the hydrolyzate) sticking to the raw material.

In order to elucidate the method according to the invention the Table below brings examples of hydrolysis experiments with bagasse pith, bagasse, grain straw and corn cobs. For example, a hydrolysis was carried out with bagasse pith, the ratio of liquid (i.e. the water originally present in the raw material plus the acid solution plus the condensed vapor) to absolutely dry raw material being 1.87 when impregnated and heated. As a result, 71% of the pentosans present were hydrolysed.

| | bagasse pith | bagasse | grain straw | corn cobs |
|---|---|---|---|---|
| RATIO Liquid/absolute Dry Raw Material before treatment | 1 | 0.17 | 0.13 | 0.136 |
| impregnated and heated up | 1.87 | 1.07 | 1.06 | 0.72 |
| acid | sulfuric | sulfuric | sulfuric | sulfuric |
| acid on dry material % | 5.5 | 4 | 1.94 | 2 |
| time min. | 180 | 240 | 60 | 60 |
| temperature ° C. | 100 | 97 | 135 | 130 |
| rate of pentosane hydrolysed % | 71 | 68 | 82 | 79 |
| for comparison: Ratio Liquid/Absolute Dry Raw Material as would be obtained by immersion according USP | 5.25 4 023 982. | 5.66 | 3.54 | 1.77 |

The comparison of the ratio liquid/dry material of 1.87 with the corresponding ratio of 5.25 at saturation as occurs with the method according to U.S. Pat. No. 4,023,982, where bagasse pith is impregnated by immersion, shows that according to the invention only 35.6% of the liquid, which would have been absorbed until saturation, was needed.

With the other examples in the Table, the quantity of liquid needed amounts to 18.9%, 29.9% and 40.7% of the quantity absorbed when impregnating by immersion for bagasse, grain straw and corn cobs respectively.

From the Table it follows that according to the invention the extent of spraying the raw material with the acid is such that the ratio of liquid to absolutely dry raw material in the raw material after spraying and heating does not exceed 70% of the ratio which would be obtained by impregnating raw material by means of immersion for 10 minutes in the acid solution. Thereafter, the raw material is heated to reaction temperature by live steam of a temperature of about 100° to 140° C. The heated raw material is kept at this reaction temperature for a time sufficient to produce, in combined effect with the acid solution and the temperature, a hydrolysis of at least 60% of the xylan contained in the raw material to xylose solution in between 30 and 240 minutes. Finally, the raw material so hydrolysed is washed with water in counter-flow to extract the xylose solution therefrom.

Since the hydrolytic action of acids is a rigid function of the H-ion concentration and, consequently, the concentration of the acid and not its quantity is decisive for the hydrolysis, the reduction in quantity of liquid means a correspondingly large saving in acid consumed.

There also results a reduced vapor consumption for heating the impregnated raw material due to the lower liquid content as well as a higher concentration of sugar in the extract, which means a saving in vapor for the evaporation of the sugar solution.

In the case of vapor treatment, the raw material is impregnated with acid vapor and heated in one operation, the inflowing acid vapor penetrating into the pores of the raw material while expelling the air therefrom, and condenses evenly in the pores of the colder raw material, thereby heating the raw material via the heat of condensation. The quantity of acid solution necessary is equal to the quantity of condensate formed in the raw material only, and thus is far less than the quantity which would be taken up when impregnating by immersion. After the raw material has been heated by the heat of condensation, the temperature of the acid vapor in the pores remains the same for the time during which hydrolysis takes place. Unlike the treatment by spraying described above, the reaction takes place in an acid vapor atmosphere. The xylose which formed is, as above, dissolved in the liquid (the hydrolyzate) sticking to the raw material.

After hydrolysis, the xylose is extracted from the raw material by a counterflow wash, insofar as the hydrolysed raw material permits the streaming through of washing water. This may be done in a column through which the hydrolysed raw material flows and in which washing water is guided in counter flow to the raw material.

In case the hydrolysed raw material, due to its structure, does not permit extraction in a column, then the extraction of the xylose may take place by means of multistep mixing of the hydrolysed raw material with washing water being led in counter flow to the raw material. According to one embodiment, the hydrolysed raw material is conveyed on a travelling screen through a plurality of washing-water spraying zones connected in series. The washing water after passing through the raw material within the range of a spraying zone, is collected at the under side of the travelling screen and subsequently constitutes the washing water for the preceeding spraying zone. Dependent on the extent to which the hydrolysed raw material is able to pass washing water, the passing of washing water may be enhanced by suction cells arranged below the screen. The water collected in a suction cell then constitutes the washing water for the preceeding spraying zone.

In case the hydrolysed raw material is not able to pass washing water sufficiently, not even when in thin layers, then the extraction of the xylose from the hydrolysed raw material mainly takes place by means of squeezing. The squeezing is repeated several times, for example by means of a sequence of presses, as after one squeeze a considerable portion of the hydrolyzate remains in the hydrolysed raw material. Before the last press of the series of presses, fresh washing water is added to the hydrolysed raw material. The hydrolyzate squeezed out by the first press of the series, which has the highest concentration of xylose, is processed further in order to obtain xylose therefrom.

The extraction solutions may be recirculated between the squeezing zones to the extent that the hydrolysed raw material can be supplied to the presses in suspended, pumpable form. This preferred embodiment of the counterflow extraction by squeezing operates as follows.

In order to remove the hydrolysate from the raw material hydrolysed according to the described method, the raw material is first suspended in a hydrolysate that results at the end of the method (see below). In so doing, the hydrolysate already formed in the raw material is diluted only to a small extent.

The xylose is now extracted from the raw material saturated with hydrolysate. This takes place in the manner described above in a sequence of squeezing and washing steps. In the first squeezing zone, the main quantity of hydrolysate mixture of the suspension is squeezed out. A portion of this hydrolysate, which possesses the highest xylose concentration utlimately obtainable, is purified in order to obtain the xylose therefrom. A second portion of the hydrolyzate is branched off for the described preparation of the suspension with the hydrolysed raw material. It is also possible to use a hydrolysate for the suspension that has a lower concentration of xylose than the hydrolysate of the first squeezing zone by deriving the hydrolysate from a further squeezing zone of the sequence. In the subsequent squeezing steps, which are alternated by washing steps, the washing water in the washing stages is preferably led in counterflow to the flow of raw material, so that the remaining hydrolyzate is diluted as little as possible.

What is claimed is:

1. A method of manufacturing a xylose solution from a xylan containing plant raw material in particular animal plants which is very water absorbent in the dry state, said method comprising the steps of spraying the raw material with an acid to an extent sufficient to permit hydrolysis of the xylan to xylose without completely saturating the raw material;

heating the raw material to a temperature sufficient to effect hydrolysis of the xylan to a xylose solution; and thereafter washing the acid-treated and heated raw material in counterflow with water to extract the xylose solution therefrom.

2. A method as set forth in claim 1 wherein said step of heating includes the step of passing a flow of water vapor through the raw material to heat the raw material.

3. A method as set forth in claim 1 wherein said washing step occurs in an extraction column.

4. A method as set forth in claim 1 wherein said washing step includes a multiple-step mixing of the hydrolysed raw material with washing water and a subsequent separation of the washing water and raw material.

5. A method as set forth in claim 4 wherein said multiple-step mixing includes a conveyance of the hydrolysed raw material on a traveling screen through a plurality of washing water spraying zones connected in series, and the use of the washing water of one spraying zone as the washing water of a preceding spraying zone in said series after passing through the raw material in said spraying zone.

6. A method as set forth in claim 4 which further includes the steps of squeezing the hydrolysed raw material in a first squeezing zone upstream of said series of washing zones and in at least a second squeezing zone downstream of at least one of said washing zones.

7. A method as set forth in claim 6 which further comprise the step of suspending the hydrolysed raw material in a hydrolysate obtained from at least one of said squeezing and washing zones prior to said washing step, and the hydrolysate is obtained from said zone containing the highest xylose concentrate.

8. A method of manufacturing a xylose solution from a xylan-containing plant raw material in particular annual plants which is very water absorbent in the dry state, the method comprising the steps of spraying the raw material with an acid solution to such an extent that the ratio of water originally present in the raw material together with the acid solution and the condensed water vapor of the step following hereinafter to the over-dry raw material is such that the raw material is not saturated completely with liquid after the step following hereinafter;

heating the sprayed raw material with saturated water vapor to a temperature sufficient to effect the hydrolysis of the xylan to the xylose solution; and washing the acid impregnated, heated and hydrolysed raw material in counterflow with water to extract the xylose solution therefrom.

9. A method of manufacturing a xylose solution from xylan-containing plant raw material in particular annual plants which is very waterabsorbent in dry state, said method comprising the steps of spraying the raw material with acid to such an extent that the ratio of liquid to absolutely dry material in the raw material after spraying and heating does not exceed 70% of that ratio which would be obtained by immersing said raw material for 10 minutes in said acid solution;

heating the raw material at reaction temperature by live steam;

keeping the heated raw material at reaction temperature for a time sufficient to produce in combined effect with the acid solution and the temperature a hydrolysis of minimum 60% of the xylan of the raw material to xylose solution; and thereafter washing the acid-treated heated and hydrolysed raw material in counterflow with water to extract the xylose solution therefrom.

* * * * *

UNITED STATES PATENT AND TRADEMARK OFFICE

CERTIFICATE OF CORRECTION

PATENT NO. : 4,226,638

DATED : October 7, 1980

INVENTOR(S) : Hansjorg Pfeiffer

It is certified that error appears in the above—identified patent and that said Letters Patent is hereby corrected as shown below:

Column 3, line 38, delete "5.25" after "Absolute";

"5.25" should be under the column entitled "bagasse pith";

"5.66" should be under the column entitled " bagasse";

"3.54" should be under the column entitled "grain straw";

"1.77" should be under the column entitled "corn cobs".

Column 3, line 41, "4 023 982" should be adjacent "USP".

Signed and Sealed this

*Third* Day of *March 1981*

[SEAL]

*Attest:*

RENE D. TEGTMEYER

*Attesting Officer*

*Acting Commissioner of Patents and Trademarks*